US008894020B2

(12) United States Patent
Rosener

(10) Patent No.: US 8,894,020 B2
(45) Date of Patent: Nov. 25, 2014

(54) BLOCK MODULE FOR MODEL TRAIN LAYOUT CONTROL

(76) Inventor: Harvey J. Rosener, Sherwood, OR (US)

( * ) Notice: Subject to any disclaimer, the term of this patent is extended or adjusted under 35 U.S.C. 154(b) by 400 days.

(21) Appl. No.: 13/385,548

(22) Filed: Feb. 24, 2012

(65) Prior Publication Data

US 2012/0221181 A1 Aug. 30, 2012

Related U.S. Application Data

(60) Provisional application No. 61/464,218, filed on Feb. 28, 2011.

(51) Int. Cl.
*A63H 19/24* (2006.01)
*A63H 19/32* (2006.01)

(52) U.S. Cl.
CPC ..... *A63H 19/24* (2013.01); *A63H 19/32* (2013.01); *A63H 2019/246* (2013.01)
USPC ..... 246/473 A

(58) Field of Classification Search
CPC ..... A63H 19/24; A63H 19/32; A63H 30/02
USPC ..... 246/473 A; 701/19
See application file for complete search history.

(56) References Cited

U.S. PATENT DOCUMENTS 4,307,302 A * 12/1981 Russell ..... 307/40
4,349,196 A * 9/1982 Smith et al. ..... 463/6
5,623,518 A * 4/1997 Pfiffner ..... 375/278
5,749,547 A * 5/1998 Young et al. ..... 246/4
6,441,570 B1 * 8/2002 Grubba et al. ..... 318/3
6,624,537 B2 * 9/2003 Westlake ..... 307/125
6,766,988 B1 * 7/2004 Richley ..... 246/20
6,947,815 B2 * 9/2005 Young et al. ..... 701/19
7,142,954 B2 * 11/2006 Neiser ..... 701/19
7,501,775 B2 * 3/2009 Valdemarsson et al. ..... 318/16
7,856,296 B2 * 12/2010 Katzer ..... 701/19
7,885,735 B2 * 2/2011 Katzer ..... 701/19
8,502,483 B2 * 8/2013 Young et al. ..... 318/268
2001/0015578 A1 * 8/2001 Westlake ..... 307/125
2003/0155470 A1 * 8/2003 Young et al. ..... 246/122 A
2004/0200934 A1 * 10/2004 Young et al. ..... 246/122 A
2005/0023416 A1 * 2/2005 Wolf et al. ..... 246/167 R
2005/0129410 A1 * 6/2005 Wilsey et al. ..... 398/153
2007/0001058 A1 * 1/2007 Severson ..... 246/1 R
2007/0164169 A1 * 7/2007 Wolf et al. ..... 246/1 R
2008/0091312 A1 * 4/2008 Katzer ..... 701/19
2010/0330875 A1 * 12/2010 Severson ..... 446/454
2012/0199701 A1 * 8/2012 Wolf et al. ..... 246/187 A

* cited by examiner

*Primary Examiner* — Zachary Kuhfuss
(74) *Attorney, Agent, or Firm* — Francis I. Gray

(57) ABSTRACT

A Block Module for controlling a model railroad layout, the layout being subdivided into a plurality of block districts with each block district represented by one or more of the Block Modules, is a programmable processor having inputs for receiving serial data in a loop from other Block Modules and transmitting the serial data to other Block Modules, as well as inputs for receiving data from elements in the layout and information from other Block Modules and outputs for controlling elements in the layout and communication with other Block Modules. One of the Block Modules in the loop is designated as a Master Block Control Module, and the Block Modules respond to commands transmitted from the Master Block Control Module, to commands manually entered at the block district level, and to communications from related Block Modules to control the layout on a distributed basis.

7 Claims, 10 Drawing Sheets

Input and Output pins of the Block Module

| | | |
|---|---|---|
| 1 | RJ45 | SW0 Switch engine drive(2), feedback(2), Manual SW(2), and Ground 7 (16 volts) |
| 2 | RJ45 | SW1 Switch engine drive(2), feedback(2), Center LED and ground 6 (16 volts) |
| 3 | RJ45 | SW2 Switch engine drive(2), feedback(2), Manual SW(2), and Ground 7 (16 volts) |
| 4 | RJ45 | SW3 Switch engine drive(2); feedback(2), Center LED and ground 6 (16 volts) |
| 5 | RJ45 | SW4 Switch engine drive(2), feedback(2), Manual SW(2), and Ground 7 (16 volts) |
| 6 | RJ45 | SW5 Switch engine drive(2), feedback(2), Center LED and ground 6 (16 volts) |
| 7 | RJ45 | SW6 Switch engine drive(2), feedback(2), Manual SW(2), and Ground 7 (16 volts) |
| 8 | RJ45 | SW7 Switch engine drive(2), feedback(2), Center LED and ground 6 (16 volts) |
| 9 | RJ45 | Decimal inputs 0, 1, 2, 3, 4, 5, 6 and gnd (Push Buttons) 8 (5 Volts) |
| 10 | RJ45 | Four inputs and 3 outputs and GND 8 (5 Volts) |
| 11 | RJ45 | Seven Segment readout #1, (7) and +5 volts (1) Voltage unknown |
| 12 | RJ45 | Seven Segment readout #2, Enable L1, Enable L2, Enable L3, Enable L4, GND 7, 8, 9 |
| 13 | RJ45 | Two sensor inputs, GND, Output yard signal, Gnd, Input yard signal, Gnd 7 |
| 14 | RJ45 | CAT 5 input from preceding Block Module 6 |
| 15 | RJ45 | CAT 5 output from Next Block Module 6 |
| 16 | RJ45 | Seven sensors inputs and GND 8 |
| 17 | RJ45 | Seven sensors inputs and GND 8 |

FIG. 4b

BK = Block # S = Speed in Block
L# = Locomotive # In Block
LS = Locomotive Speed Pc or LCD_TV or IPAD View Y = Yard #
L# = Locomotive # In Yard
DES # = description of block or track

| BK | DES | SP | L# | LS | BK | DES | SP | L# | LS | BK | DES | SP | L# | LS | Y | DES | L# | Y | DES | L# | Y | DES | L# |
|---|---|---|---|---|---|---|---|---|---|---|---|---|---|---|---|---|---|---|---|---|---|---|---|
| 1 | | 30 | | | 22 | | 30 | | | 43 | | 45 | | | 1 | T0G | | 22 | | | 43 | | |
| 2 | | 30 | | | 23 | | 10 | | | 44 | | 55 | | | 2 | T1G | | 23 | | | 44 | | |
| 3 | | 30 | | | 24 | 333 | 30 | 32 | 25 | 45 | | 55 | | | 3 | T2G | | 24 | | | 45 | | |
| 4 | | 10 | | | 25 | | 30 | | | 46 | 432 | 45 | 555 | 56 | 4 | T3G | | 25 | | | 46 | | |
| 5 | | 30 | | | 26 | | 30 | | | 47 | | 30 | | | 5 | T4G | | 26 | | | 47 | | |
| 6 | 1112 | 30 | 112 | 28 | 27 | | 45 | | | 48 | | 30 | | | 6 | T5G | | 27 | | | 48 | | |
| 7 | | 30 | | | 28 | | 55 | | | 49 | | 10 | | | 7 | T6G | | 28 | | | 49 | T0A | |
| 8 | | 45 | | | 29 | | 55 | | | 50 | | 30 | | | 8 | T7G | 4532 | 29 | | | 50 | T1A | |
| 9 | | 55 | | | 30 | 88 | 55 | 99 | 50 | 51 | | 30 | | | 9 | T0H | | 30 | | | 51 | T0D | |
| 10 | | 55 | | | 31 | | 45 | | | 52 | | 30 | | | 10 | | | 31 | T0B | | 52 | T1D | |
| 11 | | 55 | | | 32 | | 30 | | | 53 | | 45 | | | 11 | | | 32 | T1B | | 53 | T0F | 5 |
| 12 | | 45 | | | 33 | | 30 | | | 54 | | 55 | | | 12 | | | 33 | T2B | | 54 | T1F | |
| 13 | | 30 | | | 34 | | 45 | | | 55 | | 55 | | | 13 | | | 34 | T3B | 44 | 55 | T2F | |
| 14 | | 30 | | | 35 | | 45 | | | 56 | | 55 | | | 14 | | | 35 | T0E | | 56 | T3F | 69 |
| 15 | | 45 | | | 36 | | 45 | | | 57 | | 45 | | | 15 | | | 36 | T1E | | 57 | | |
| 16 | 678 | 45 | 4449 | 30 | 37 | | 45 | | | 58 | | 30 | | | 16 | | | 37 | | | 58 | | |
| 17 | | 45 | | | 38 | | 30 | | | 59 | 4454 | 30 | 4343 | 25 | 17 | | | 38 | | | 59 | | |
| 18 | | 45 | | | 39 | | 30 | | | 60 | | 45 | | | 18 | | | 39 | | | 60 | | |
| 19 | | 30 | | | 40 | | 30 | | | 61 | | 45 | | | 19 | | | 40 | | | 61 | | |
| 20 | | 30 | | | 41 | | 45 | | | 62 | | 45 | | | 20 | | | 41 | | | 62 | | |
| 21 | | 30 | | | 42 | | 45 | | | 63 | | 45 | | | 21 | | | 42 | | | 63 | | |

Block identified by switch in Block Module (16) | Red = Block occupied | Block identified by switch in Switch Module (30)

FIG. 9

BLOCK MODULE FOR MODEL TRAIN LAYOUT CONTROL

CROSS-REFERENCE TO RELATED APPLICATION

This non-provisional patent application claims the priority filing date of provisional U.S. Patent Application Ser. No. 61/464,218 filed Feb. 28, 2011 entitled "Model Railroad Layout Block Detection and Occupancy", which is hereby incorporated by reference.

BACKGROUND OF THE INVENTION

The present invention relates to model railroad control systems, and more particularly to a Block Module for model train layout control.

Model railroading has become a major hobby to a large number of people, with the result that there are model railroad clubs that have very large model railroad layouts that encompass multiple trains, switches, signals and other elements that need to be controlled or set up by a user. A model railroad layout can be as simple as a single oval of track with perhaps a single crossover to form a figure-eight, and be as complex as those built by such model railroad clubs. For simple configurations where only one or two trains may be run, an operator usually can see all of the components and control all the objects within the layout easily from a single position. However, for such large layouts as those in a model railroad club that may encompass a very large room and include a very complex system, usually a roadmaster controls the system via a handheld device or a computer, such as a personal computer, from a master layout board while different members of the club may control different trains, i.e., the locomotives that haul the trains. Also where there are switching yards, there may be a local yardmaster assigned to control shunting of the trains to different sidings and dead ends. The members operating the locomotives do not want to be bothered with the details of how the layout is setup and operates, but merely wish to control their individual trains to get from one point in the layout to another by communicating their desires to the roadmaster, who in turn sets up the appropriate switches, signals, etc. that allow the trains to get to their destinations without running into each other.

To control such complex layouts, a Java Model Railroad Interface (JMRI) open source software project has been produced that seeks to build tools for model railroad computer control. There are two major subsytems involved: a direct computer control (DCC) subsystem for controlling locomotives so that locomotives on the same electrical section of track may be independently controlled; and a panel layout control that allows the user to draw a panel in any way desired and animate parts of it to show the status of the layout, i.e., where trains are and their status, as well as providing control over them.

In the JMRI system each independently controllable element is assigned manually a discrete JMRI address by the handheld controller or computer, and then each element may be controlled by addressing from the handheld device or computer that element's address while providing, along with the address, the desired operation of the element. This means that, when multiple trains are running on a model railroad layout, each locomotive has its own address and each controllable element, such as switches, signals, etc., also each have their own unique address. The DCC subsystem, for example, operates by modulating the voltage on the track to encode digital messages while providing electric power for the locomotives, i.e., the voltage to the track is a bipolar DC signal. Power from the tracks also may be used to control lights, smoke generators and sound generators on the selected locomotive. Each user may control a separate locomotive via a wireless controller in communication with the model railroad computer.

The roadmaster generally controls the layout, and the individual operators communicate with the roadmaster to determine routes, switching, etc. so that the operator can move his train along a desired path to specific destinations without interfering with trains controlled by other operators. The entire JMRI system is rather complicated as the addresses for each element of the layout have to be assigned. Further the model railroad layout has bulk wiring, of which few operators have any knowledge. Most people just want to run the trains and not deal with the structure of the layout. Therefore the JMRI system takes centralized control of the model train layout without two-way communication between various parts of the layout. As indicated, the communication takes place with the DCC signals on the track transmitted from the computer or handheld device. The current JMRI has no knowledge that the device has received the communication, but assumes the desired action has occurred.

What is desired is a non-complicated, user-friendly system for running a model train layout without understanding the status of the train layout, while providing two-way communication between various parts of the layout with simplified wiring.

BRIEF SUMMARY OF THE INVENTION

Accordingly the present invention provides a configurable Block Module for model train layout control that provides local control over elements within block districts within the layout without requiring DCC addresses and signals sent on the tracks by a computer, while providing two-way communication between the various block districts of the layout. The model railroad layout is subdivided into a plurality of block districts representing sections of the track layout and associated elements. Block Modules are connected in a loop to as many other Block Modules as necessary to emulate the layout. Where multiple Block Modules represent the layout, one of the Block Modules is designated as a Master Block Control Module. Each block district is represented by one or more block modules, as required to define the particular block district. Each Block Module is coupled to multiple input elements, such as sensors in the track, and provides commands to controllable elements coupled to the Block Module, such as switches, signals, etc., as well as communicating with related Block Modules. Each Block Module may be a separate printed circuit board with a configurable processor that holds information about the portion of the layout represented by the Block Module, as well as information about the other Block Modules, and with a flash memory that is used to store configuration data, unique area name and speed limit when the Block Module power is turned off.

The objects, advantages and other novel features of the present invention are apparent from the following detailed description when read in conjunction with the appended claims and attached drawing figures.

BRIEF DESCRIPTION OF THE SEVERAL VIEWS OF THE DRAWING

FIG. 4*b* is a representative view of a table representing the inputs and outputs for the Block Module.

FIG. 9 is a plan view of one version of a master layout display according to the present invention.

DETAILED DESCRIPTION OF THE INVENTION

The Block Module described herein provides decentralized control for a model train layout while providing two-way communication with other Block Modules that emulate the model train layout. The Block Modules communicate in a two-way manner using a serial data transmission system. The model train layout is subdivided into block districts that each represent a different section of tracks with associated elements within the layout. The block districts are each represented by one or more Block Modules (BMs). One of the Block Modules is designated a Master Block Control Module (MBC). The entire Block Module system may be connected to a personal computer via an appropriate connector, such as via a USB cable, to interface with the conventional JMRI system.

Figure 1:
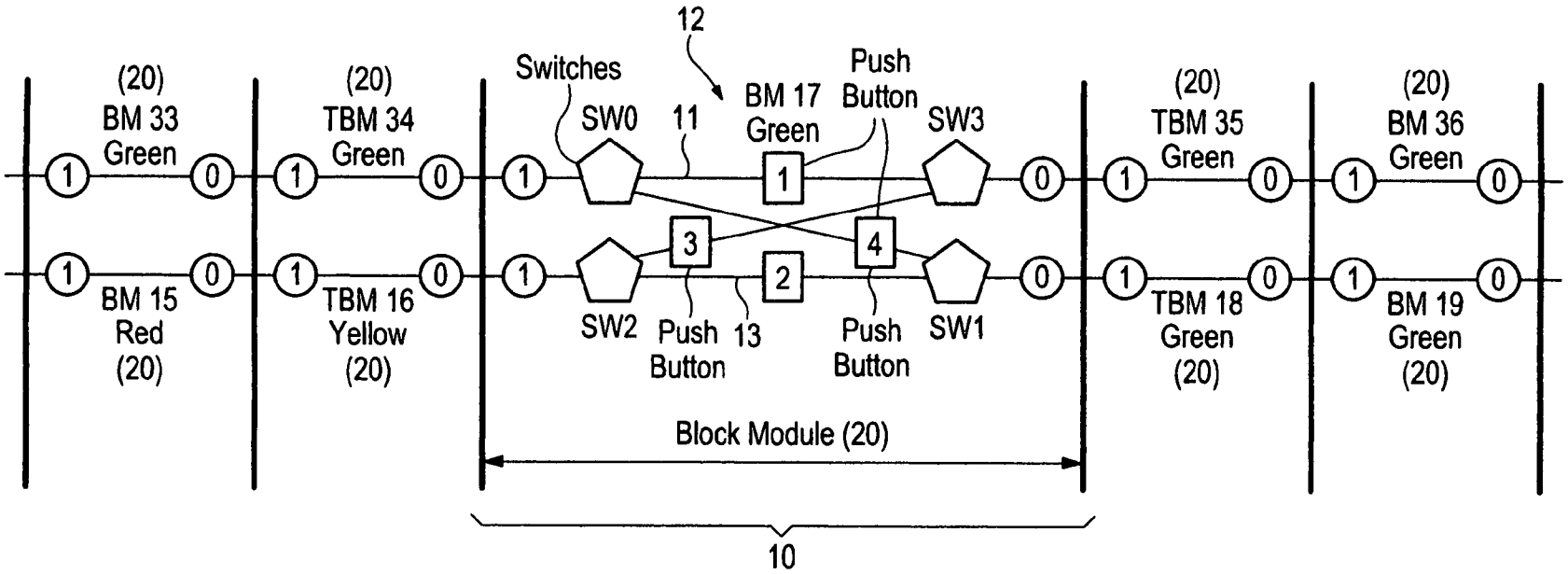
FIG. 1 is a plan view of a simple block district for a model railroad layout according to the present invention.

The number of Block Modules required to represent the complete model railroad layout depends on the complexity of the layout, and may range from a single Block Module (simple layout) to a maximum number of Block Modules as determined by the memory storage capabilities of each Block Module. A train layout, especially one developed by a model railroad club, may be very complex, as indicated above. Therefore it is easier to control the layout if the layout is divided into a plurality of block districts, each block district being represented by one or more configurable Block Modules, as described further below. A block district 10 may be very simple, such as shown in FIG. 1 which represents a pair of main line tracks 11, 13 with a crossover 12, represented by four switches SW0-SW3 and pushbuttons 1-4, between the two main lines. Such a simple block district 10 may be represented and controlled by a single Block Module 20. On each side of the Block Module 20 may be Block Modules designated as Transfer Block Modules that allow communication with Block Modules in another part of the layout. More complex block districts, such as the Wye shown in FIG. 2*a* or the railroad yard shown in FIG. 3, may be represented by several Block Modules 20. Different elements within each area represented by the Block Module 20 are coupled to the Block Module to provide information to the Block Module or to be controlled by the Block Module. Examples of information elements are train sensors located within the layout, such as those labeled numerically within circles in FIGS. 1-3, while switches located within the layout, such as those labeled SW with an associated numeral, are examples of controllable elements. For the purpose of the present description the number of switches controllable by each Block Module 20 is limited to eight. Other elements of the layout also may be controlled by the Block Module 20, such as railroad traffic semaphores, crossing guard lights and crossing gates, bridge lifts, and even time of day lighting and associated building lights.

Figure 4A:
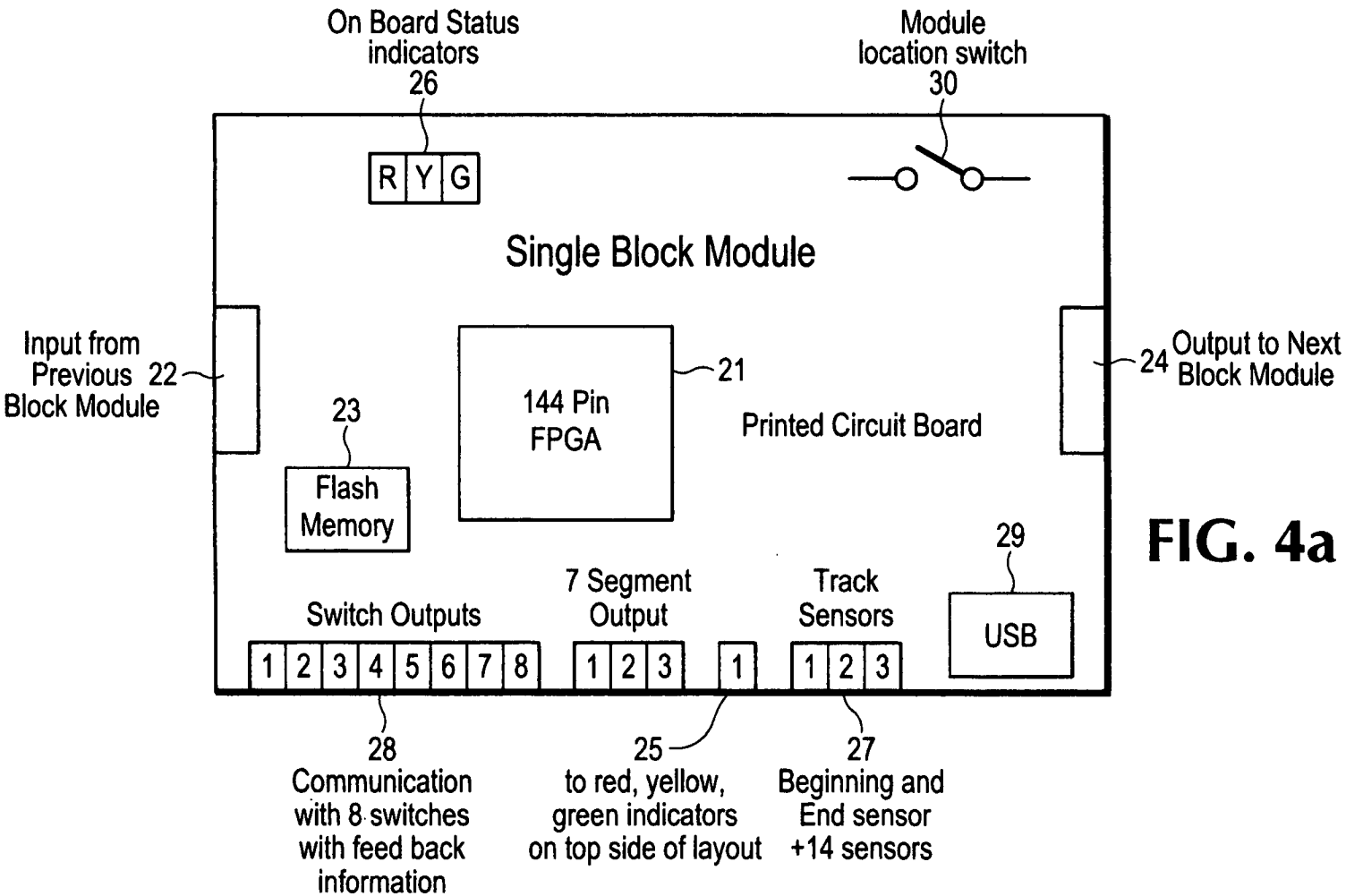
FIG. 4*a* is a representative view of a Block Module for railroad layout control according to the present invention.

Each Block Module 20, a simple version of which is shown in FIG. 4*a*, may be a single printed circuit board (PCB) which includes a configurable, programmable processor 21 with associated memory and registers. Also included on the PCB may be a flash memory 23 for storing configuration data. The configurable, programmable processor 21 may be a Field Programmable Gate Array (FPGA) as shown, such as a Xilinx FPGA. The Block Module 20 has an input connector 22 communicating with a prior Block Module, and an output connector 24 for communicating with a next Block Module. Communication between Block Modules 20 may use a conventional serial digital communication protocol, such as the CAT-5 protocol. Other connectors may be single or twisted pair connectors 27 coupled to elements in the layout to receive data, such as train sensors indicating passage of a train, or to control other elements 25, 28 such as switches, crossing gates, traffic semaphores, etc. Also a USB port 29 is provided for communicating with other processing devices, such as a personal computer for interfacing with the JMRI system. FIG. 4*b* gives a more detailed illustration of the inputs and outputs for the Block Module 20. For this illustration there are eight switch RJ45 connectors, SW0-SW7, a decimal RJ45 connector with eight lines coupled to up to eight push buttons for local, manual control, as explained below, sensor RJ45 connectors, readout RJ45 connectors, and CAT 5 RJ45 connectors. The flash memory and processor random access memory (RAM), stores configuration data that represents the particular track and switch layout which the particular Block Module represents, as well as the status of all elements to which the Block Module is connected. By changing the contents of the flash memory, the configuration of the FPGA may be reprogrammed to emulate a different layout configuration when the Block Module is powered up and the flash memory contents are transferred to the processor RAM. At power down the contents of the processor RAM are transferred to the flash memory to store the current configuration data for the Block Module.

There are multiple configurations available for each Block Module 20, depending upon the block district or portion thereof which the Block Module is emulating. FIGS. 1-3 are merely three of many possibilities. Since the Block Module 20 is configurable, it can take on a different behavior according to the needs of the local block district. During power up the Master Block Control Module reads the state of the configuration for each Block Module 20, the Block Modules being connected in series to form a loop, as described below. At the Master Control Block Module a roadmaster on a master layout display 18 may watch all locomotives in the train layout move from one block district to another with their actual locomotive numbers, as opposed to computer assigned addresses. Also at the Master Block Control Module, the layout display provides block and yard description, block speed limits and the speed of all locomotives, as discussed below.

Figure 5:
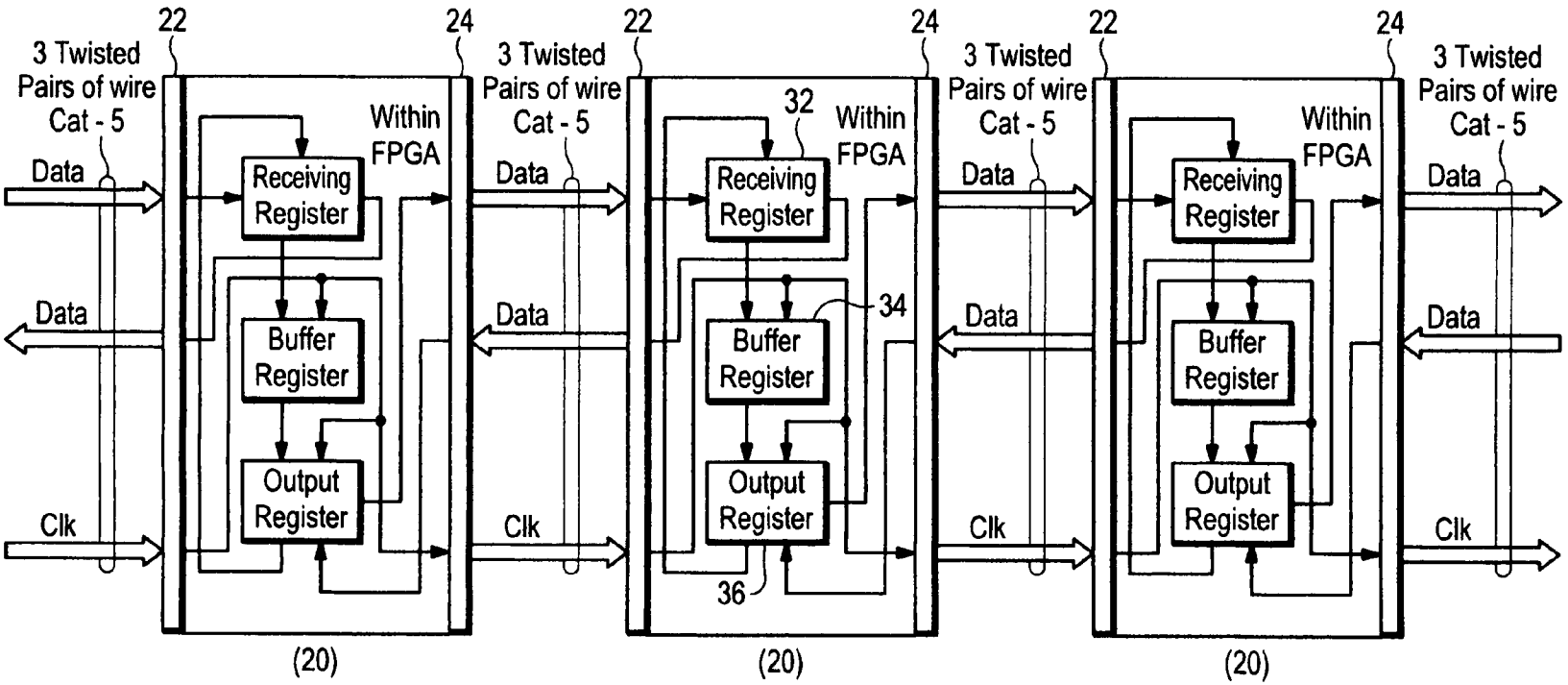
FIG. 5 is a block diagram view of a series of Block Modules coupled together according to the present invention.

As shown in FIG. 5 for a Block Module 20 using an FPGA as its programmable processor, three of four twisted pairs of wires associated with the CAT-5 serial data communication system are used to provide a clock signal to the Block Module and input and output data signals at an input connector 22. Also at an output connector 24 are input and output data signals as well as the clock signal, which is passed through the Block Module. Each FPGA has a receiving register 32 for receiving serial data from a prior Block Module 20, a buffer register 34, and an output register 36 for providing serial data to the next Block Module in the loop. The operation of these registers is discussed in more detail below.

Figure 6:
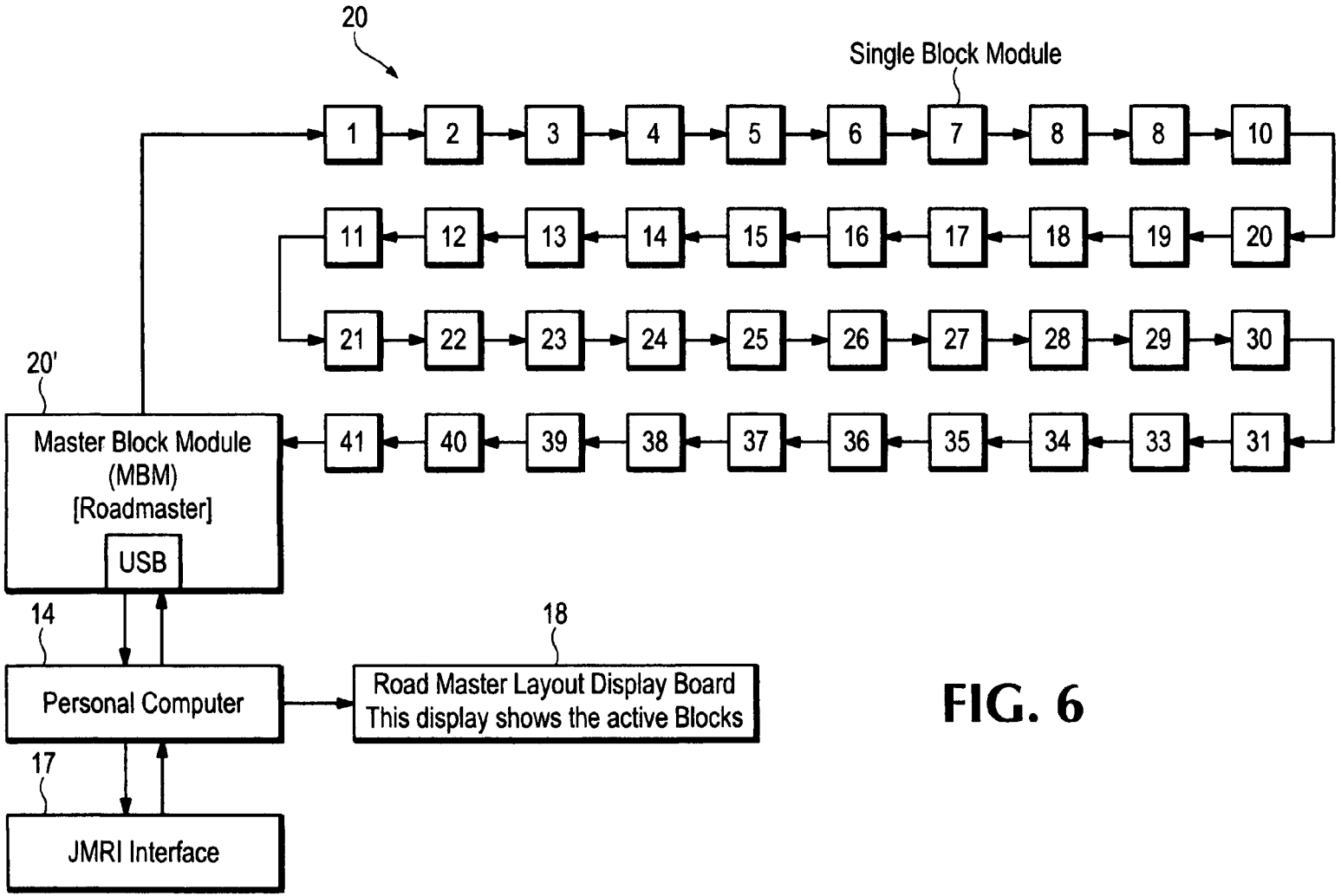
FIG. 6 is a block diagram view of the Block Module loop and interconnections with a Master Control Block Module according to the present invention.

Referring now to FIG. 6, the Block Modules 20 that emulate the entire train layout are coupled in series to form the loop of Block Modules. One of the Block Modules is designated as the Master Control Block Module 20', which is under the control of the roadmaster. The Master Control Block Module 20' is coupled to a computer 14 or other interface for communicating with a master layout display 18 and also with the conventional JMRI system via an interface 17, if desired. There are two modes of operation for the control system-loop mode and dwell mode. At power up, the Master Block Control Module 20' has no knowledge of the number of Block Modules 20 in the loop or the configuration of each of the Block Modules, so the system starts the loop mode. After the loop mode is completed, a dwell period is entered where configuration data is transferred from temporary memory to data words in each Block Module for transfer to the Master Block Control Module in the next loop mode. After the power up loop mode, operational control of the layout reverts to each Block Module 20 to conduct its distributed job, either in response to commands send by the roadmaster from the Master Control Block Module 20' during subsequent loop modes, due to local manual input, such as by a yardmaster, or in response to where locomotives are with respect to the Block Module.

When power is applied to the layout, the Master Block Control Module 20' sends a clock signal and a seed string of data words to the immediately adjacent Block Module 20, the data words in the string being separated by a defined time interval, such as a specified number of clock pulses. The Master Block Control Module 20' continues to transmit data words in the seed string until the first data word in the string is received back from the last Block Module 20 in the loop. In the example shown in FIG. 6, there are forty-one (41) Block Modules in the loop so an up-counter in the Master Block Control Module counts to 41, which makes a total of 42 data words in the seed string. The data words in the seed string may be 24-bit words with a Hex value of "FF", while the address of data words in subsequent loop modes have a Hex value "F7". By counting the number of data words in the seed string required to complete the loop, the Master Block Control Module 20' now knows the number of Block Modules 20 representing the entire layout and assigns a unique address to each one.

When the last transmitted data word in the seed string is received by the Master Block Control Module 20', an initial dwell period is entered for a specified period, such as 500 microseconds. At this time the flash memory for each Block Module transfers the configuration data to the FPGA RAM of the Block Module, which configuration data is placed in a data portion of a data word for transmission around the loop to the Master Block Control Module in the next loop mode. From subsequent loop modes after the power up loop mode, the Master Block Control Module has the complete layout configuration, which is now displayed on the master layout display 18. Any configuration changes in each Block Module during operation are transferred to data words during the dwell period and transmitted to the Master Block Control Module at the subsequent loop mode. Each Block Module 20 also counts the number of data words transmitted as part of the seed string, and also receives the configuration data for the other Block Modules during subsequent loop modes. Assuming a clock signal of 1 MHz and a layout represented by 100 Block Modules 20, the total loop operation may be approximately 2.8 milliseconds. For each Block Module 20 added to the layout, the loop period increases by approximately 28 microseconds. After completion of the loop mode, the dwell period begins and lasts the specified period so that Block Modules may perform their distributed functions and communicate with other Block Modules as needed. Any configuration changes are transferred to the processor RAM for transmission to the Master Block Control Module during the next loop mode.

Figure 7:
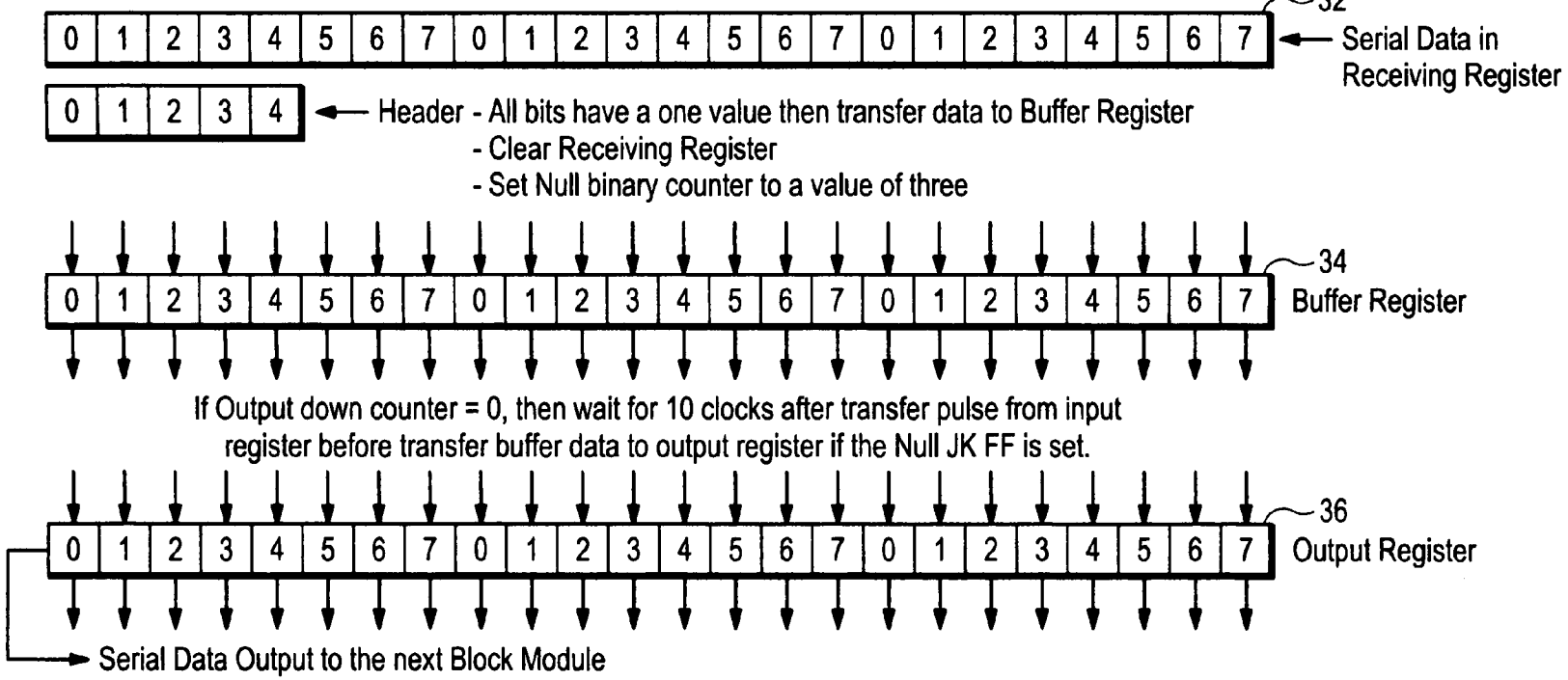
FIG. 7 is a block diagram view illustrating data flow through a Block Module according to the present invention.
Figure 8:
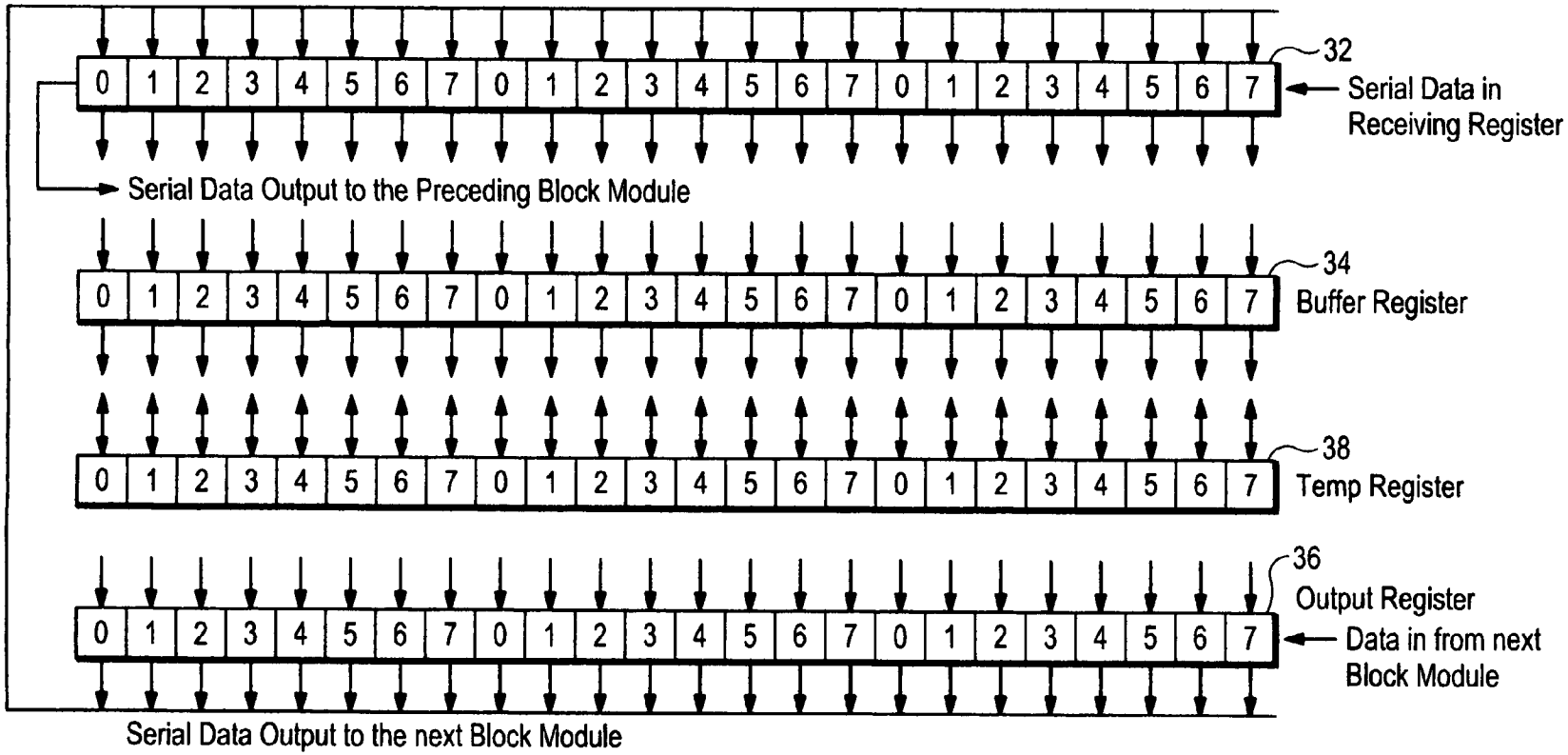
FIG. 8 is a block diagram view illustrating data flow through a Block Module during "dwell mode" according to the present invention.

FIGS. 7 and 8 show how the registers in each Block Module 20 operate to receive and transmit commands to adjacent Block Modules. FIG. 7 shows operation when data is circulating around the loop. When the Block Module sees a separation between data words of more than the defined time period for loop mode, i.e., more than four clocks, the Block Module then knows that it has entered the dwell period. When the dwell period is detected, the Block Module knows that the data received in the receiving register 32 is data to be used by the Block Module. The data from the receiving register 32 is transferred to the buffer register 34 upon detection of a header in the received data word. Data from the buffer register 34 is then transferred to the output register 36 a specified number of clocks after the header is detected in the receiving register, if not in the dwell period, for transfer out to the next Block Module in the loop. During the dwell period at power up configuration data from the flash memory is transferred to the buffer register 34 for insertion into the data portion of the data word in the output register 36 during the next loop mode. The data words from the respective output registers of the Block Modules are transferred around the loop during the next loop mode to the Master Block Control Module. Configuration changes during subsequent Block Module operations are transferred to the output register during subsequent loop modes for transmission to the Master Block Control Module to complete the two-way communication between the Block Modules and the Master Block Control Module.

Serial data is clocked into the receiving register 32 using the clock signal provided by the Master Control Block Module 20'. When a header is detected in the first locations of the receiving register 32, indicating that the entire data word has been received, the data from the receiving register is transferred in parallel to the buffer register 34 and the receiving register is cleared. If the time is such as to indicate that the received data word is the last one in the seed string, i.e., there is a greater than four clock gap between data words, the Block Module 20 then enters the dwell period and assumes that the buffer data is meant for the Block Module. Otherwise the data from the buffer register 34 is transferred in parallel to the output register 36 and then clocked out serially to the next Block Module 20 in the loop. Since the clock signal originates from the Master Control Block Module 20' and is passed through from one Block Module 20 to the next, the clock signal is synchronized with the data stream in each Block Module. The serial data and clock coming into the Master Block Module are resynchronized with the outgoing data from the Master Block Module.

During distributed operation by the Block Modules, i.e., during the dwell period, a temporary register 38 in the Block Module 20 is used, as shown in FIG. 8. The buffer register 34 is prevented from transferring data to the output register 36. Instead the buffer register transfers data in parallel to the temporary register 38. The buffer register 34 is used to put data into the data word for transmission to the Master Block Control Module 20' in the loop mode, or to transfer data to related Block Modules during the dwell period. When the first string data word in the next loop mode is received, the data in the temporary register 38 is transferred in parallel to the buffer register 34 for transfer to the output register 36, from whence the data word is communicated around the loop to the Master Block Control Module 20'. Data from the output register 36 also may be transferred in parallel to the receiving register 32 for transmission serially to the preceding Block Module 20 during the dwell period.

The important information required to prevent train accidents is to know where each locomotive is on the layout. Therefore in during operation the location of any locomotive relative to a current Block Module 20 needs to be transmitted between Block Modules. The train sensors in the layout provide information to the Block Module 20 when a train enters or leaves the Block Module. Also the number of clock pulses between the last train sensor in the exiting Block Module 20 and the first train sensor in the entering Block Module may be used to calculate the speed of the train. Therefore the exiting Block Module 20 communicates to the entering Block Module when the last train sensor senses the presence of the locomotive, and the entering Block Module then counts the clock pulses until the first sensor detects the locomotive. From the known distance between the sensors, the speed of the locomotive is computed by the entering Block Module and then transmitted around the loop to the Master Control Block Module 20'. The entering Block Module 20 then signals that the locomotive is within the Block Module, i.e., generates a red light, and the exiting Block Module signals that the locomotive has just left by generating a yellow light. The red and yellow lights are transmitted to related Block Modules 20 along the direction of train travel, as well as to the Master Control Block Module 20', for display on the layout display. Those Block Modules 20 which do not have a locomotive within their area or in an adjacent Block Module indicate this status with a green light. In this way the roadmaster knows where the various locomotives are and their speeds.

As indicated previously, the roadmaster may send commands to any one of the Block Modules 20 from the Master Block Control Module 20', and the Block Modules send back status information to the Master Block Control Module to provide two-way communication. However, certain block districts may provide local block district layout displays to allow for local manual control. Referring to FIGS. 1-3, manual pushbuttons indicated by numerals within a square may be activated to achieve certain desired actions on the local level.

In the simple layout shown in FIG. 1 the Block Modules 20 have an associated numeral that indicates where the Block Module is in the loop from the Master Block Control Module 20', i.e., in the lower main line 13 are Block Modules 15, 16, the current Block Module 17, Block Modules 18 and 19, while in the upper main line 11 are Block Modules 33, 34, 35 and 36. Because the current Block Module 20 interacts with both the main lines 11, 13, the immediately adjacent Block Modules 16, 18, 34 and 35 are Transfer Block Modules that communicate not only with the current Block Module but with Block Modules on either side of the current Block Module dependent upon the switch SW0-SW3 positions. If the pushbutton 3 or command associated with that pushbutton is activated, then communication goes, assuming a train coming from the left on the lower main line 13, from the Block Module 15 (being red to indicate the presence of a train within that Block Module) to Transfer Block Module 16 (being yellow to indicate that a train is in an adjacent Block Module, namely Block Module 15), then to the current Block Module 17 and to Transfer Block Module 35 on the upper main line 11, the Transfer Block Module 35 not being an adjacent Block Module in the loop, but a related Block Module along the direction of train travel.

Figures 2A, 2B:
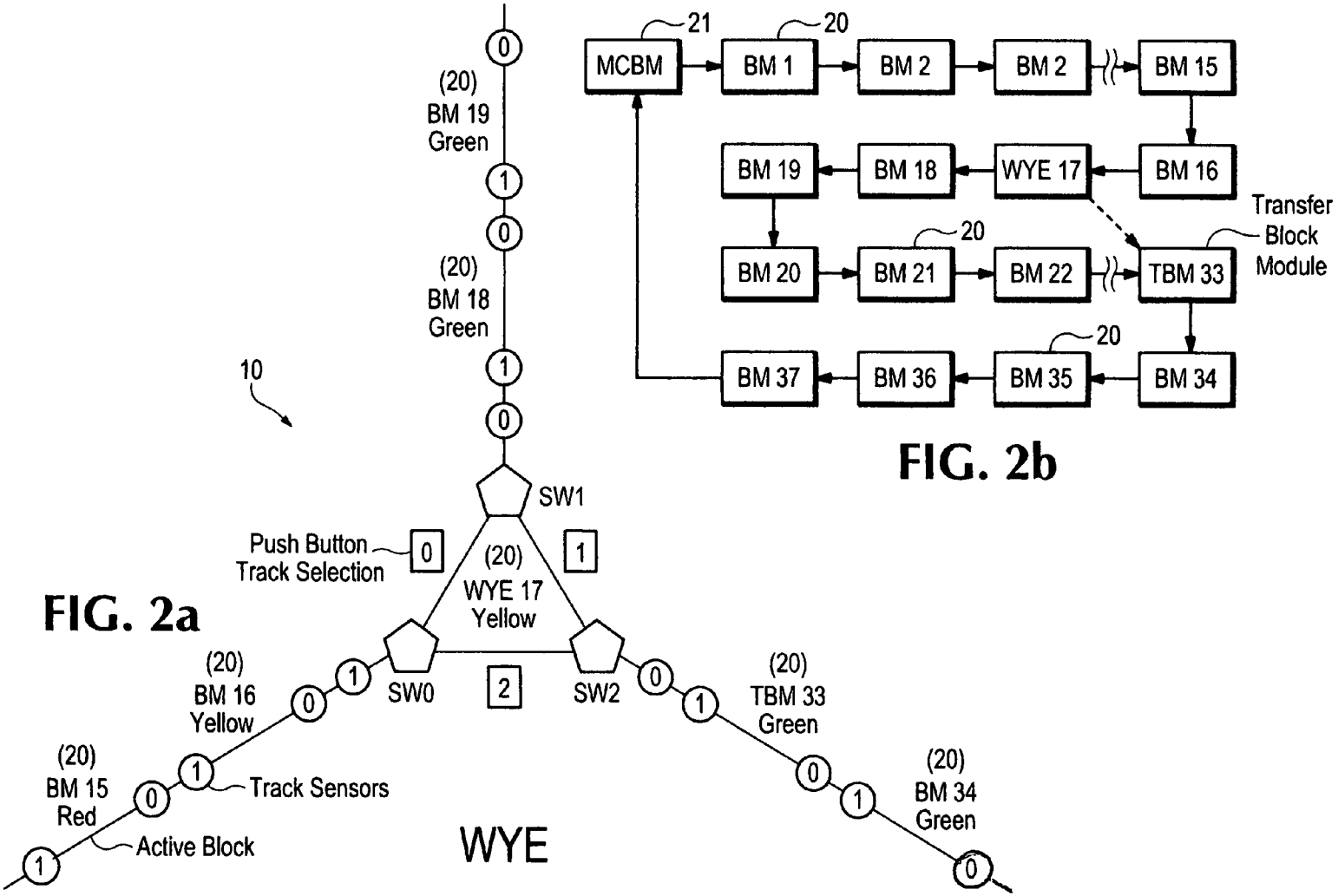
FIG. 2*a* is a plan view of a Wye block district for the model railroad layout according to the present invention.
FIG. 2*b* is a plan view of the loop of Block Modules including the Wye block district of FIG. 2*a* according to the present invention.
Figure 3:
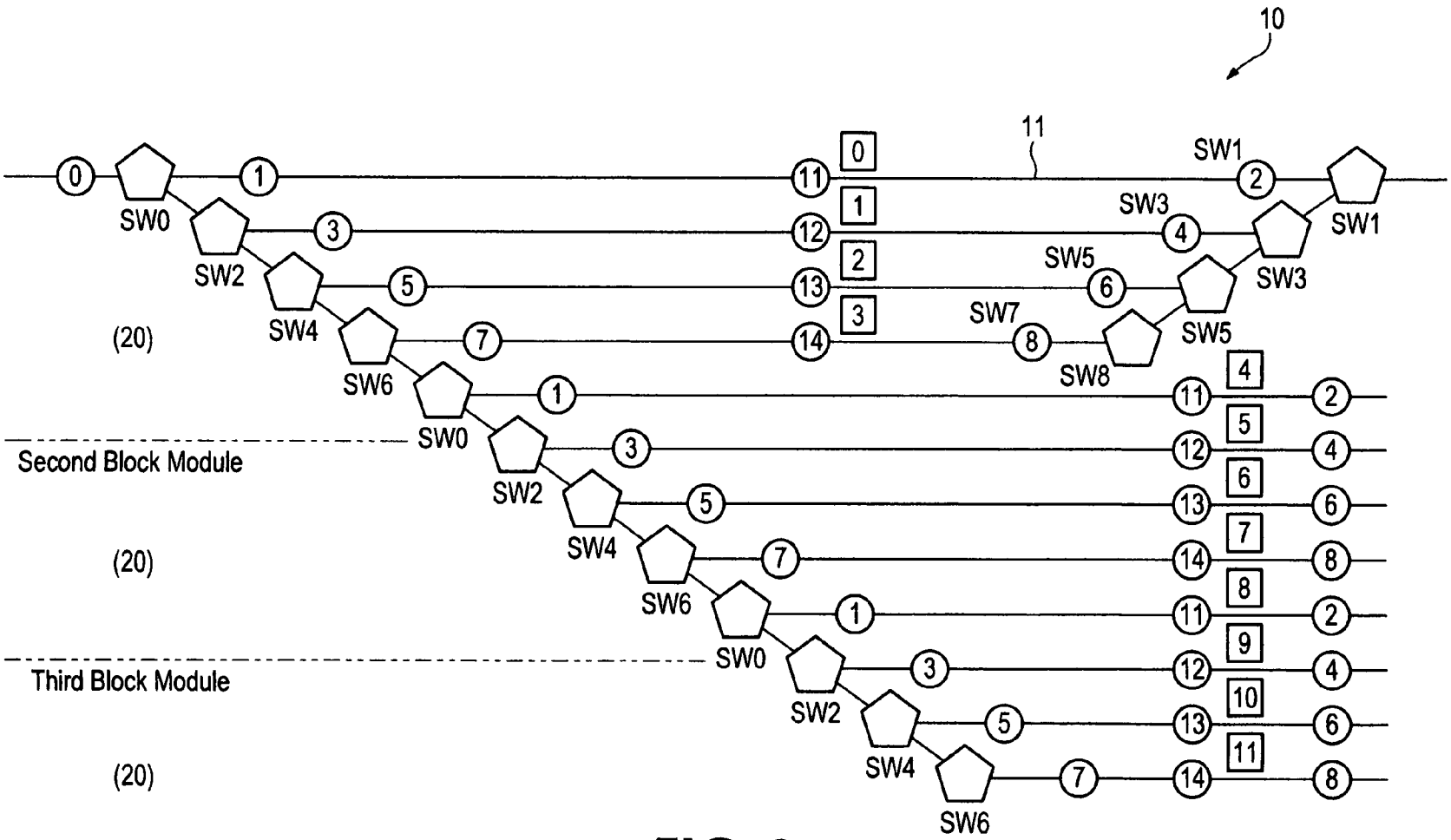
FIG. 3 is a plan view of a railroad yard for the model railroad layout according to the present invention.

FIG. 2*b* shows a Wye Block Module within a loop of Block Modules for a block district that has several Block Modules 20. The lower left arm of the Wye shown in FIG. 2*a* consists of Block Modules 15 and 16, with the Wye Block Module 17 next in the loop, and then through Block Modules 18 and 19 in the upper arm. However the Block Modules 33 and 34 in the lower right arm are not adjacent in the loop, so the Wye Block Module 17 has to communicate with Transfer Block Module 33 which is related but in a different part of the loop of Block Modules, as indicated by the dotted arrow in FIG. 2*b* which indicates a single wire connection between the two. During power up there is a routine between the Wye Block Module 17 and the Transfer Block Module 33 to establish an address link between both Block Modules. At the lower left the Block Module 15 displays a red light or status, indicating that a train is within that Block Module. The next adjacent Block Module displays a yellow light or status, indicating a train is in an adjacent Block Module. All the other Block Modules display a green light or status, indicating no trains in the immediate vicinity. There are three pushbuttons, labeled "0" through "2", that may be activated manually at the block district or via command from the Master Block Control Module 20'. Activating the "0" pushbutton results in a train being routed between the lower left arm of the Wye to the upper arm of the Wye. When the train has passed from the lower left arm to the upper arm, then the pushbutton "1" may be activated so that the train may then back from the upper arm to the lower right arm. When the train is within the lower right arm, then the pushbutton "2" may be activated so that the train may then be routed from the lower right arm to the lower left arm, but traveling in the opposite direction from the original direction, i.e., the Wye Block Module may act as a turnaround configuration for the train. The track sensors communicate to the Block Modules where the train is at all times to assure that the switches are cleared before the activation of any other pushbutton can take effect. The Block Modules have a connecting line to each other so they can communicate this information to each other.

FIG. 3 shows a railroad yard having a main line 11 with four sidings and several dead end sidings. Again there are multiple Block Modules 20 used to emulate and control this yard. The yard may be configured to any depth with different yard configurations using additional Block Modules. A local yardmaster may manually shunt a train from the mainline to any one of the sidings, as desired, via activation of any one of the corresponding pushbuttons "0"-"11" on the local display for the block district. For example, if it is desired that a train be shunted from the mainline to the last dead end siding, the yardmaster activates the pushbutton "11". The third Block Module then activates its switches SW0, SW2, SW4 and SW6 and communicates to the second Block Module, which in turn activates its switches SW0, SW2, SW4 and SW6. Finally the second Block Module communicates to the mainline Block Module, which in turn activates its switches SW0, SW2, SW4 and SW6 so that now, with the activation of a single pushbutton "11", the switches in the Block Modules are configured to shunt a train, coming from the left, to the last dead end siding represented by the third Block Module. The train sensors "7", "8" and "14" in the last dead end siding of the third Block Module indicate when the train is completely on the siding. If all three sensors detect the train simultaneously, a light associated with the middle sensor is activated by the third Block Module to flash to indicate that the train is too long for the siding. Otherwise, when the first sensor is cleared by the train and the last sensor has not been energized, the third Block Module sets the light to steady. When the last sensor on the siding detects the train, the third Block Module signals for the train to stop in order to prevent the train from running off the track at the end of the siding. In this example using three Block Modules 20, there is a communication between them to indicate the status of each. Each of the Block Modules is a separate PCB. During initialization the three Block Modules are queried consecutively by the seed string from the Master Block Control Module 20' for the represented section of tracks before moving on to the next adjacent block district with associated Block Modules, the first Block Module in the adjacent block district being a Transfer Block Module since the first Block Module of the yard in this example is not adjacent the first Block Module of the adjacent block district in the loop of Block Modules.

As shown in FIG. 4*a*, there also is a module locator switch 30 located in each Block Module 20 which is a manual switch, such as a toggle switch. When a locomotive engineer desires to insert a new locomotive on the layout within a particular Block Module 20 while the layout is powered up, the module locator switch 30 for that Block Module is closed, and communication via the loop back to the Master Control Block Module 20' tells the roadmaster the location of the Block Module within which the new locomotive is inserted. With that knowledge, the roadmaster may insert the locomotive number within that Block Module on the master layout display board. Then the module locator switch 30 is opened to resume normal operation of the layout.

Alternatively, if available, locomotives may be added using radio frequency identification (RFID) techniques. An RFID reader under the tracks on the layout may detect, not only the locomotive, but also any cars in the train that have RFID capability. The RFID information from the RFID reader is input to a first-in/first-out (FIFO) buffer in the associated Block Module 20 via a USB connector. The contents of the FIFO are transmitted to the Master Block Control Module 20'. With the RFID information, a time stamp and location is added to the data. This helps to keep track of any car or locomotive on the layout. In this manner the roadmaster may put together a manifest to give instructions on how to put a train together and where the train is to be delivered. An RFID tag is placed on each locomotive and car. The tag may include not only the locomotive or car number, but also the owner's name. With many RFID readers spread throughout the layout, even within each Block Module region, a new dimension is added for the train operator.

The beginning, middle and end block train sensors may be of any type which detect the presence of a train passing by, such as light sensors, magnetic sensors, pressure sensors, magnetometer sensors or the like.

Block Modules 20 may be added or removed at any time that the layout is powered down. The Master Control Block Module 20' detects the changes in the loop length when the layout is powered back up, and identifies Block Module new or old locations, and manages the system memory. The changes are then reflected in the master layout display 18 for the information of the roadmaster.

The master layout display 18 may be represented like a Microsoft® EXCEL spreadsheet, as shown in FIG. 9. In this illustration there are 63 blocks and yards listed which make up the model train layout. The occupied blocks, 6, 16, 24, 30, 46 and 59 are highlighted in an appropriate manner to indicate that there is a locomotive in each of those blocks. Each block has a speed limit (SP) indicated, a description of the block (indicated with letters and numbers), the locomotive number for the locomotive which is in that block (which may be the number painted on the actual locomotive), and the actual locomotive speed (LP) of the locomotive within the block. Likewise each yard having a locomotive at a siding is indicated by the locomotive number and appropriate highlighting. Again each yard has a description of the yard layout. As the locomotives move around the model railroad layout, the roadmaster can follow on the master layout display where they all are within the layout and their speeds.

In this illustration Block Module 20 indicated by the address "6" is specifically highlighted in an appropriate color to indicate that a new locomotive has been introduced at that Block Module. The other Block Module addresses which have a locomotive number associated with them are not so highlighted, indicating that these locomotives are already operating on the layout. Also the yard address "8" also shows by highlighting that a new locomotive has been introduced at that location as well.

Block Modules 20 which control subsidiary elements on the layout, such as bridge lifts, crossing guards and gates, etc., may include counters that count clocks when the particular element is activated to determine the speed at which such actions occur over time. The time of day lighting may be controlled similarly by the Master Block Control Module, while each Block Module controls building lighting accordingly within its block district. The programmability of the Block Modules 20 gives the roadmaster extensive control over the layout in order to produce a more realistic environment for the train operators.

Thus the present invention provides a Block Module for model railroad layout control that is programmable to emulate, either alone or with other Block Modules, any configuration of a local block district of the layout in order to provide distributed control of the layout, the Block Modules being coupled in a loop to emulate the entire layout with one of the Block Modules being designated as a Master Control Block Module, so that a roadmaster may keep track of the location of all locomotives operating on the layout block district by block district on a master layout display, as well as control the routing of the locomotives, without the need for having digital computer control addresses for each element of the layout.

What is claimed is:

1. A model railroad block control system comprising:

a plurality of Block Modules coupled in series to form a loop with one of the Block Modules being designated a Master Block Control Module, each Block Module having a programmable processor, an input connector, an output connector and a flash memory for storing configuration data, for storing a brief description of the Block Module and for storing block district speed limits representing a portion of a model railroad layout being emulated by the Block Module, the output connector of the Master Block Control Module being coupled to the input connector of a first Block Module in the loop and the input connector of the Master Control Block Module being coupled to the output connector of a last Block Module in the loop; and a master layout display coupled to the Master Control Block Module for showing locations of locomotives within the model railroad layout to a roadmaster;

the Master Control Block Module transmitting, when electrical power is applied to the model railroad layout, a seed string of data words around the loop of Block Modules until the first data word in the seed string is received back at the Master Block Control Module, the number of data words in the seed string received at the Master Block Control Module determining the number of Block Modules in the loop and information added to the data words by the Block Modules in the loop providing the configuration data from the flash memory for each of the Block Modules to the Master Block Control Module for display on the master layout display, the Block Modules subsequently operating in a distributed processing fashion in a dwell mode to control elements within the portion of the model railroad layout being emulated and to update the Master Block Control Module accordingly.

2. The model railroad block control system as recited in claim 1 wherein each Block Module is coupled to receive data from elements within the model railroad layout and to control other elements within the model railroad layout.

3. The model railroad block control system as recited in claim 2 wherein the elements from which the Block Modules receive data comprise train sensors located within the model railroad layout near train entry and exit points for the Block Module.

4. The model railroad block control system as recited in claim 2 wherein the elements from which the Block Modules receive data comprise:

a unique radio frequency identification tag attached to each of the elements; and a radio frequency identification reader embedded in the tracks of the layout to read the radio frequency identification tags, the radio identification reader coupled to transfer information from the radio frequency identification tags to the Block Module.

5. The model railroad block control system as recited in claim 2 wherein the elements which the Block Modules control include switches, semaphores, building lighting, crossing guard lights, crossing gates and bridge lifts.

6. The model railroad block control system as recited in claim 1 wherein the Block Modules each include a timer for controlling a speed at which the elements, which perform functions over time, operate.

7. A method of distributed processing control of a model railroad layout comprising the steps of:

dividing the model railroad layout into a plurality of block districts, each block district being emulated by one or more programmable Block Modules, each programmable Block Module being configured to represent the block district or portion thereof being emulated;

coupling the programmable Block Modules in a loop and designating one of the Block Modules as a Master Block Control Module;

at power up of the model railroad layout, transmitting a seed string of data words in a loop mode around the loop from the Master Block Control Module until a first data word in the seed string is received back at the Master Block Control Module, the number of data words in the seed string indicating the number of programmable Block Modules in the loop and information added to the data words by the programmable Block Modules in the loop indicating the configuration of each of the programmable Block Modules;

displaying the model railroad layout at the Master Block Control Module as determined from the data words received back from the seed string;

operating the model railroad layout in a dwell mode through each programmable Block Module in a distributed manner after completion of the loop mode in response to commands transmitted from the Master Block Control Module by a roadmaster, in response to local manual commands entered at the block district, or in response to locations of locomotives relative to the programmable Block Module; and transmitting to the Master Block Control Module changes in status of the model railroad layout from the programmable Block Modules executing the changes.

* * * * *